US005722816A

United States Patent [19]

Shimada et al.

[11] Patent Number: 5,722,816

[45] Date of Patent: Mar. 3, 1998

[54] GAS COMPRESSOR

[75] Inventors: Koichi Shimada; Seiichiro Yoda, both of Narashino, Japan

[73] Assignee: Seiko Seiki Kabushiki Kaisha, Japan

[21] Appl. No.: 705,541

[22] Filed: Aug. 29, 1996

[30] Foreign Application Priority Data

Aug. 31, 1995 [JP] Japan ..... 7-223791

[51] Int. Cl.[6] ..... F04B 49/00

[52] U.S. Cl. ..... 417/310; 417/295; 417/440

[58] Field of Search ..... 417/295, 310, 417/440

[56] References Cited

U.S. PATENT DOCUMENTS

| | | | |
|---|---|---|---|
| 5,035,584 | 7/1991 | Akaike et al. | 417/310 |
| 5,145,327 | 9/1992 | Nakajima et al. | 417/310 |
| 5,364,235 | 11/1994 | Bearint | 417/295 |

FOREIGN PATENT DOCUMENTS

| | | |
|---|---|---|
| 220801 | 5/1987 | European Pat. Off. . |
| 4016865 | 11/1990 | Germany . |

*Primary Examiner*—Charles G. Freay

*Attorney, Agent, or Firm*—Adams & Wilks

[57] ABSTRACT

The compressor has a cylinder chamber, a control plate provided with an inlet hole, a gas exchange chamber, and gas supply passages. The cylinder chamber is in communication with the gas exchange chamber via the inlet hole in the control plate. The gas exchange chamber is in communication with the outside via the gas supply passages. When the displacement is small, a part of refrigerant gas inside the cylinder chamber is bypassed to the gas exchange chamber from the inlet hole in the control plate. Therefore, great pressure variations are induced in the gas exchange chamber, but the gas exchange chamber is in communication with the outside via the considerably long gas supply passages. These passages mitigate the pressure variations transmitted to the outside. Furthermore, the passages act also as a muffler. Consequently, pressure variations inside the gas exchange chamber are prevented from being transmitted to external piping and so on; otherwise noise would be produced.

3 Claims, 8 Drawing Sheets

GAS COMPRESSOR

BACKGROUND OF THE INVENTION

The present invention relates to a gas compressor used in an air-conditioner or the like and, more particularly, to a variable displacement gas compressor.

FIG. 8 schematically shows the prior art variable displacement gas compressor in cross section. This gas compressor has a front head 2 and a cylinder chamber 1 in which refrigerant gas is to be compressed. To make variable the amount by which the refrigerant gas is compressed within the cylinder chamber 1, a control plate 3 is rotatably mounted between the front head 2 and the cylinder chamber 1. This control plate 3 is provided with a concave inlet port 3*a* in its outer surface. The area of the inlet port 3*a* is varied according to the angular position of the control plate 3. This permits the compression volume of the cylinder chamber 1 to be adjusted. An intake port 6 in communication with the outside is formed over an inlet chamber 5.

In this variable displacement gas compressor, when the motor (not shown) rotates a rotor 7 to thereby actuate vanes (not shown) slidably mounted in the rotor 7, external refrigerant gas is drawn into the cylinder chamber 1 from the intake port 6 through the inlet chamber 5 and the inlet port 3*a* as indicated by the arrow A, so that the gas is compressed. If the area of the inlet port 3*a* is increased in order to reduce the compression volume, as the vanes turn, a part of the refrigerant gas once drawn into the cylinder chamber 1 is forced back into the inlet chamber 5 via the inlet port 3*a* prior to compression. That is, the gas is bypassed to the inlet chamber 5. Just when the vanes pass across the end of the inlet port 3*a*, the compression is started. The refrigerant compressed inside the cylinder chamber 1 is supplied into an oil separator 9*a* mounted in a discharge chamber 9, as indicated by the arrow B. In this oil separator, the refrigerant is separated from the lubricating oil, and only the refrigerant gas is discharged to the outside through a discharge port.

In this prior art variable displacement gas compressor, when the displacement is small, the control plate is rotated so as to increase the area of the inlet port 3*a*. Therefore, the gas is supplied in quantity from the cylinder chamber 1 into the inlet chamber 5 via the inlet port 3*a*. Consequently, larger pressure variations are caused in the inlet chamber 5. The pressure variations are transmitted to external piping and evaporator, thus producing noise.

Use of a muffler may be generally contemplated to solve this problem. However, if such a muffler is used, the whole machine is made bulky. Also, the cost of fabricating the machine is increased greatly, thus presenting a new problem.

SUMMARY OF THE INVENTION

Accordingly, it is an object of the present invention to provide a variable displacement gas compressor in which inlet pressure variations are suppressed without increasing the size of the whole machine and without increasing the fabrication cost, thereby preventing noise which would otherwise be created by the inlet pressure variations.

The above object is achieved in accordance with the teachings of the invention by a variable displacement gas compressor comprising: a gas compression portion for compressing gas by a volume change caused by rotary motion of a rotating body; a gas exchange chamber placed at a first side of said gas compression portion and acting to exchange the gas with said gas compression portion; a control means disposed between said gas exchange chamber and said gas compression portion and having an opening for placing said gas compression portion and said gas exchange chamber in communication with each other, said opening having an effective area, said control means being designed to control compression volume of said gas compression portion by adjusting the effective area of said opening; a gas discharge portion disposed at a second side of said gas compression portion and having a discharge opening from which the gas compressed in said gas compression portion is discharged; and gas supply passages having a gas inlet port for drawing in gas, said gas inlet port being located at said second side of said gas compression portion, said gas supply passages permitting supply of gas to said gas compression portion.

In one feature of the invention, the gas supply passages are connected with the gas exchange chamber via the gas discharge portion and via the gas compression portion.

In another feature of the invention, the gas supply passages are connected with the gas discharge portion which is, in turn, connected with the gas compression portion.

In the novel gas compressor, when the compression volume of the gas compression portion is small, the control means temporarily bypasses a large amount of gas in the gas compression portion to the gas exchange chamber. This induces great pressure variations in the gas exchange chamber. These pressure variations would normally be transmitted to external piping and evaporator. However, the gas exchange chamber where the great pressure variations are produced is in communication with the outside via the gas supply passages. Furthermore, the inlet port in the gas supply passages is located on the opposite side of the gas compression portion from the gas exchange chamber and so the gas supply passages are at considerable distances from the outside. Therefore, the gas supply passages mitigate the pressure variations transmitted to the outside, the pressure variations being created inside the gas exchange chamber. Hence, the pressure variations are not readily transmitted to the outside. Moreover, the gas supply passages serve as a muffler. As a consequence, the pressure variations created inside the gas exchange chamber are prevented from being transmitted to the external piping and evaporator; otherwise noise would be produced.

Other objects and features of the invention will appear in the course of the description thereof, which follows.

DETAILED DESCRIPTION OF THE PREFERRED EMBODIMENTS

The preferred embodiments of the present invention are hereinafter described in detail by referring to FIGS. 1–7.

Figure 1:
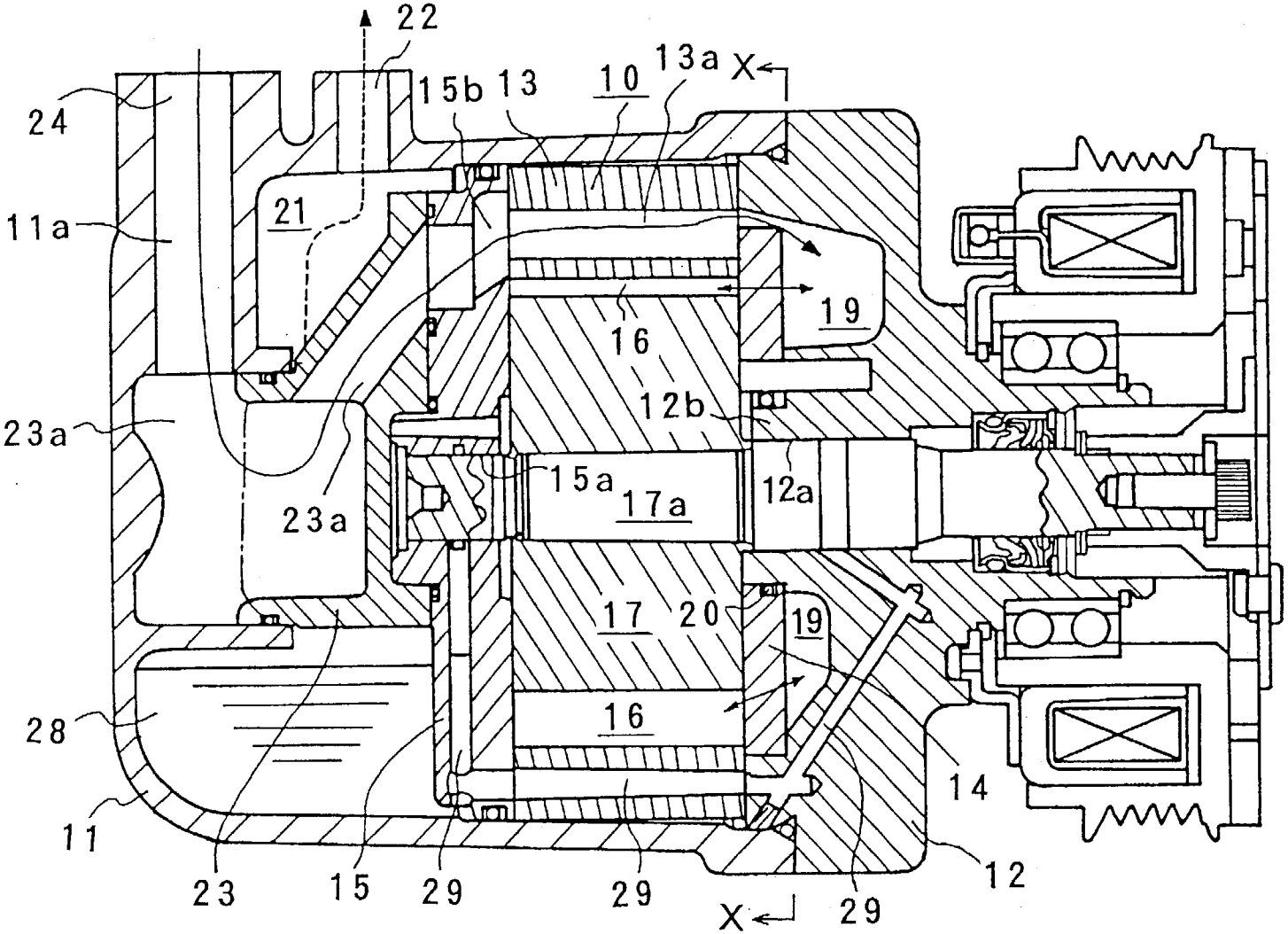
FIG. 1 is a cross-sectional view of a gas compressor according to the present invention, taken on line A—A of FIG. 2.
Figure 2:
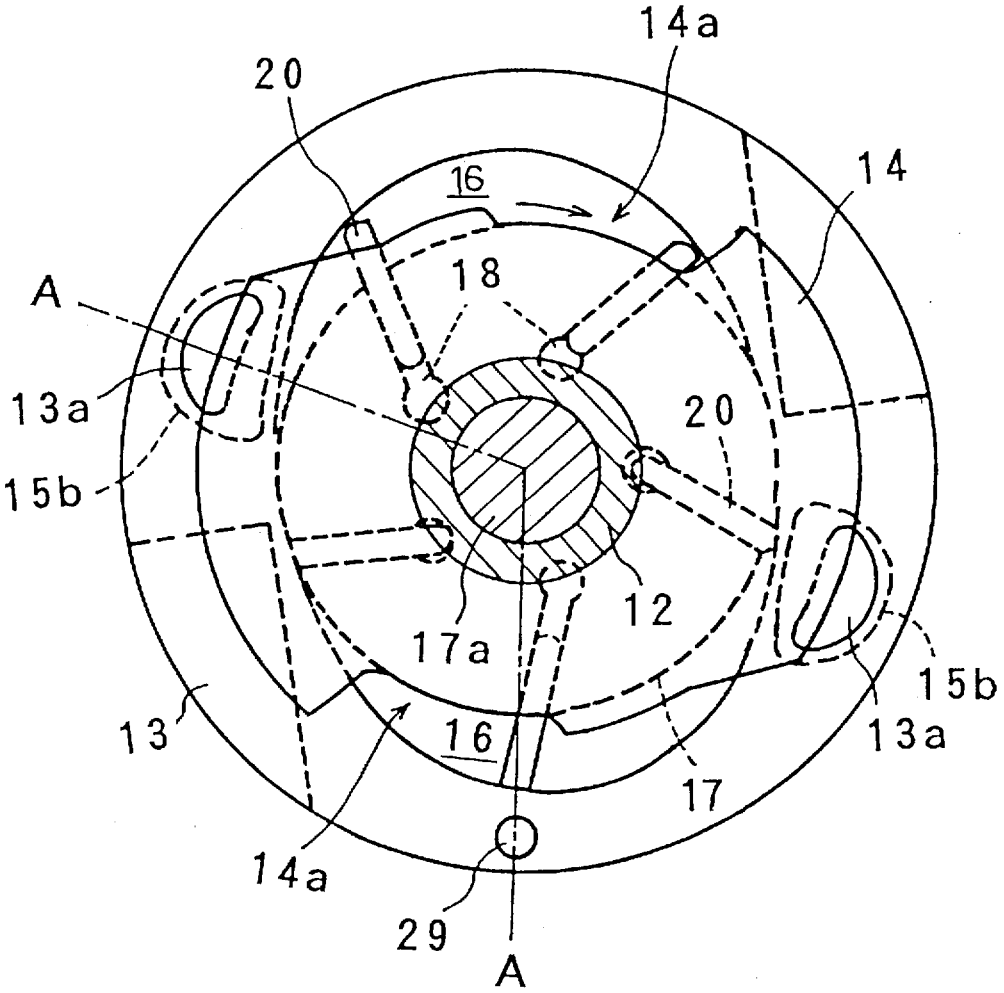
FIG. 2 is a partially cutaway view taken on line X—X of FIG. 1, and in which the compression volume takes its minimum value.
Figure 3:
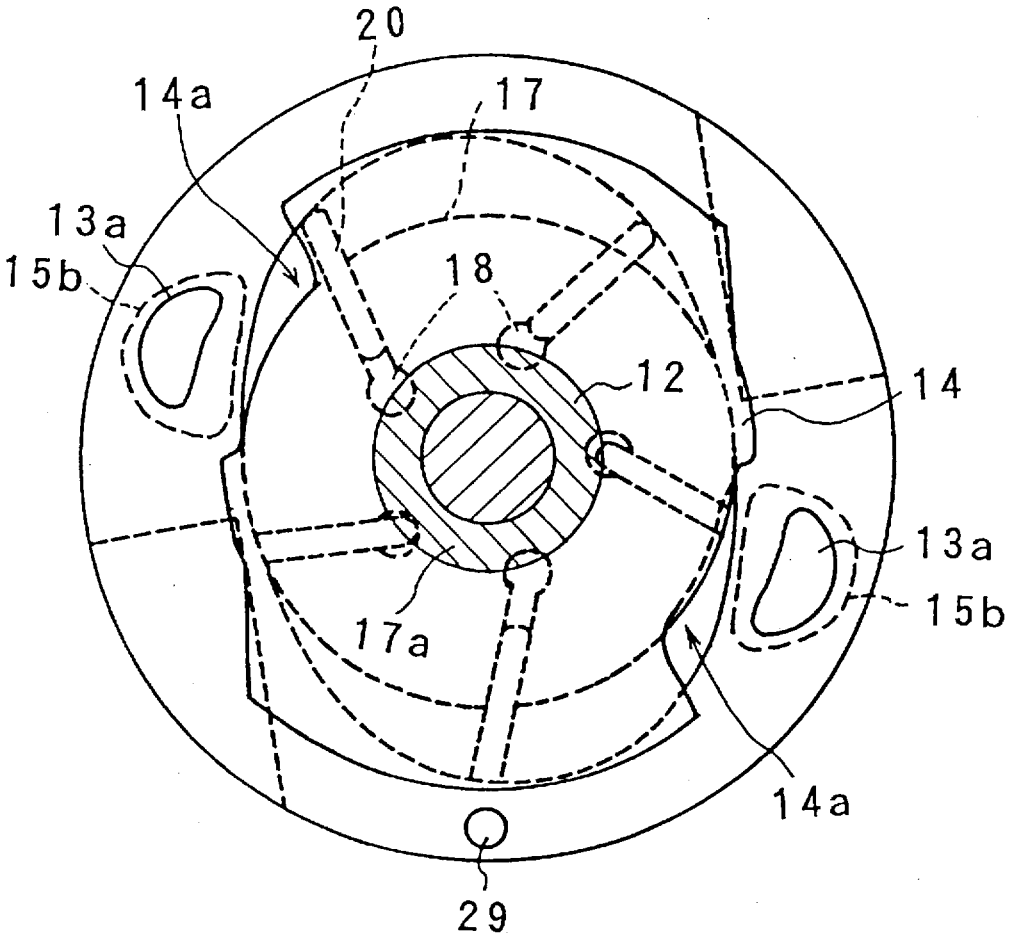
FIG. 3 is a partially cutaway cross section taken on line X—X of FIG. 1, and in which the compression volume takes its maximum value.

FIG. 1 is a cross-sectional view of a gas compressor according to the present invention. FIG. 2 is a partially cutaway cross section taken on line X—X of FIG. 1. FIG. 2 shows the state in which the compression volume assumes its minimum value. FIG. 3 is a partially cutaway cross-sectional view taken on line X—X of FIG. 1. FIG. 3 shows the state in which the compression volume assumes its maximum value.

As shown in FIG. 1, this gas compressor comprises a gas compression portion 10, a casing 11 surrounding the gas compression portion 10, and a front head 12. The casing 11 has an opening at its one side. The front head 12 is mounted so as to close off the opening in the casing 11.

The gas compression portion 10 comprises a cylindrical block 13, a control plate 14 rotatably mounted to the right end surface of the cylindrical block 13 as described later, and a rear-side block 15 firmly secured to the left end surface of the cylindrical block 13. The axial cross section of the inner surface of the cylindrical block 13 assumes an elliptical form. Thus, an elliptical cylinder chamber 16 is formed.

As shown in FIG. 2, a rotor 17 has five vanes 20 slidably held in slits 18, and is housed in the cylinder chamber 16. This rotor 17 is mounted integrally with a rotor shaft 17*a*. Bearing support holes 12*a* and 15*a* are formed in the front head 12 and the rear-side block 15, respectively, and have a diameter slightly larger than that of the rotor shaft 17*a*. The left and right sides of the rotor shaft 17*a* are rotatably held in the holes 12*a* and 15*a*, respectively. One end of the rotor shaft 17*a* is connected to a motor (not shown). When the rotor 17 is rotated, the five vanes 20 rotate in intimate contact with the inner wall surface of the cylinder chamber 16 by centrifugal force and the hydraulic pressure inside the slits 18, thus compressing refrigerant gas.

A gas exchange chamber 19 for taking in refrigerant gas to be compressed inside the cylinder chamber 16 and for exchanging the refrigerant gas with the cylinder chamber 16 as described later is formed in the front head 12. The space surrounded by the rear-side block 15 and the casing 11 forms a discharge chamber 21 having a discharge port 22.

The front head 12 has a boss 12*b* on the side of the cylindrical block 13. The aforementioned control plate 14 assuming the form of a flat plate is centrally provided with a fitting hole. The control plate 14 fits over the boss 12*b* via a bearing 20 so as to be rotatable within a given range of angles. Recessed inlet holes 14*a* are formed in given positions in the outer surface of the control plate 14 and located opposite to each other, as shown in FIG. 2. The gas exchange chamber 19 and the cylinder chamber 16 are in communication with each other via these two inlet holes 14*a*. As described later, the inlet holes 14*a* act also as bypass holes for bypassing refrigerant gas to be drawn into the cylinder chamber 16 to the gas exchange chamber 19 except when the displacement takes its maximum value. The control plate 14 is rotated by the gas compression volume achieved as described later. This rotation is carried out by a rotating mechanism (not shown).

The cylinder block 13 is provided with axially extending gas supply passages 13*a*. These gas supply passages 13*a* are located opposite to each other inside the cylindrical block 13, as shown in FIGS. 1 and 2. One end of each gas supply passage 13*a* is connected with the gas exchange chamber 19, while the other end is connected with a gas supply passage 15*b* which extends in the direction of thickness of the rear-side block 15. The gas supply passage 15*b* is in communication with the outside via gas supply passages 23*a*, 11*a* and via the intake port 24 that is an entrance to the gas supply passage 11*a*. The gas supply passage 23*a* is formed in a part of a cyclone block 23 which forms an oil separator as described later. The gas supply passage 11*a* is formed in the casing 11. Therefore, the gas exchange chamber 19 is in communication with the outside via the gas supply passages 13*a*, 15*b*, 23*a*, and 11*a* extending into the discharge chamber 21. The distance from the gas exchange chamber 19 to the outside is considerably large.

A discharge hole (not shown) extends in the direction of thickness of the rear-side block 15 to discharge the gas compressed in the cylinder chamber 16. The aforementioned cyclone block 23 is mounted to the rear-side block 15. The cyclone block 23 is provided with a passage (not shown) in communication with the discharge hole formed in the rear-side block 15. A cylindrical filter (not shown) is mounted at the end of this passage, thus forming the oil separator described above.

An oil reservoir 28 for storing lubricating oil is formed at the bottom of the discharge chamber 21. Lubricating oil supply passages 29 extend through the rearside block 15, cylindrical block 13, and front head 12 to permit the lubricating oil to be supplied from the oil reservoir 28 into the bearing support holes 12*a*, 15*a*, and other parts.

The operation of the gas compressor constructed in this manner is described below. When the compression volume of the refrigerant gas in the cylinder chamber 16 is greatest, the control plate 14 is in the position shown in FIG. 3. Under this condition, as the rotor 17 rotates, the vanes 20 are driven. This forces external refrigerant gas into the cylinder chamber 16 through the intake port 24, the gas supply passages 11*a*, 23*a*, 15*b*, 13*a*, the gas exchange chamber 19, and the inlet hole 14*a* in the control plate 14, as indicated by the solid line in FIG. 1. The drawn refrigerant gas is compressed by the movement of the vanes 20 without being bypassed to the gas exchange chamber 19 from the inlet hole 14*a*. After completion of this compression, the refrigerant gas is expelled from the discharge hole (not shown) formed in the rear-side block 15. Then, the gas flows through the passage formed in the cyclone block 23 and through the filter described above. As a result, the lubricating oil is separated and discharged into the discharge chamber 21. As a consequence, only the refrigerant gas is discharged to the outside through the discharge port 22 in the discharge chamber 21, as indicated by the broken line.

When the gas compressor is operated in this way, a pressure difference is developed between the discharge chamber 21 and the bearing support holes 12*a*, 15*a*. The discharge chamber 21 is at a higher pressure. This forces the lubricating oil in the oil reservoir 28 inside the discharge chamber 21 into the bearing support holes 12*a* and 15*a* through the lubricating oil supply passages 29. Then, the oil is used to lubricate sliding parts.

If the control plate 14 is rotated in a clockwise direction from the position shown in FIG. 3, the amount of compression of the refrigerant gas in the cylinder chamber 16 decreases gradually. If the control plate 14 reaches the position shown in FIG. 2, the compression volume is about 10% of the maximum value. This is a practical minimum value.

When the compression volume assumes its minimum value in this way, the area of the inlet opening in the cylinder chamber 16 takes its maximum value, as shown in FIG. 2. Therefore, the refrigerant gas drawn into the cylinder chamber 16 by movement of the vanes 20 is bypassed in quantity to the gas exchange chamber 19 via the inlet hole 14*a* until compression by the vanes is started.

Therefore, pressure variations in the gas exchange chamber 19 are increased. Normally, the increased pressure variations would be transmitted to the external piping and evaporator. However, the gas exchange chamber 19 in which the pressure variations are caused is placed in communication with the outside via the gas supply passage 13*a*, 15*a*, 23*a*, and 11*a*. Furthermore, the distance to the outside is considerably large. Accordingly, these gas supply passages 13*a*, 15*b*, 23*a*, and 11*a* mitigate the pressure variations transmitted to the outside, the variations being created inside the gas exchange chamber 19. Consequently, the pressure variations are less transmitted to the outside. Moreover, the gas supply passages 13*a*, 15*b*, 23*a*, and 11*a* act as a muffler. Hence, it is unlikely that the pressure variations produced inside the gas exchange chamber 19 are transmitted to the external piping, evaporator, and so on to thereby produce noise.

In the gas compressor built as described thus far, the gas exchange chamber 19 for exchanging the refrigerant gas between the cylinder chamber 16 is placed in communication with the outside via the gas supply passages 13*a*, 15*b*, 23*a*, and 11*a*. These gas supply passages 13*a*, 15*b*, 23*a*, and 11*a* prevent pressure variations produced inside the gas exchange chamber 19 from being transmitted to the outside. Accordingly, in this embodiment, pressure variations produced inside the gas exchange chamber 19 are kept from being transmitted to external piping, evaporator, and so on without increasing the size of the whole machine and without incurring a great increase in the cost of fabricating the machine; otherwise noise would be created.

Furthermore, in this embodiment, the gas supply passage 23*a* is mounted independent of the oil separator inside the cyclone block 23 which forms the oil separator. Consequently, any special piping for constituting the gas supply passage 23*a* is dispensed with. Hence, increases in the number of the components can be suppressed. Also, the fabrication cost can be suppressed.

Figure 4:
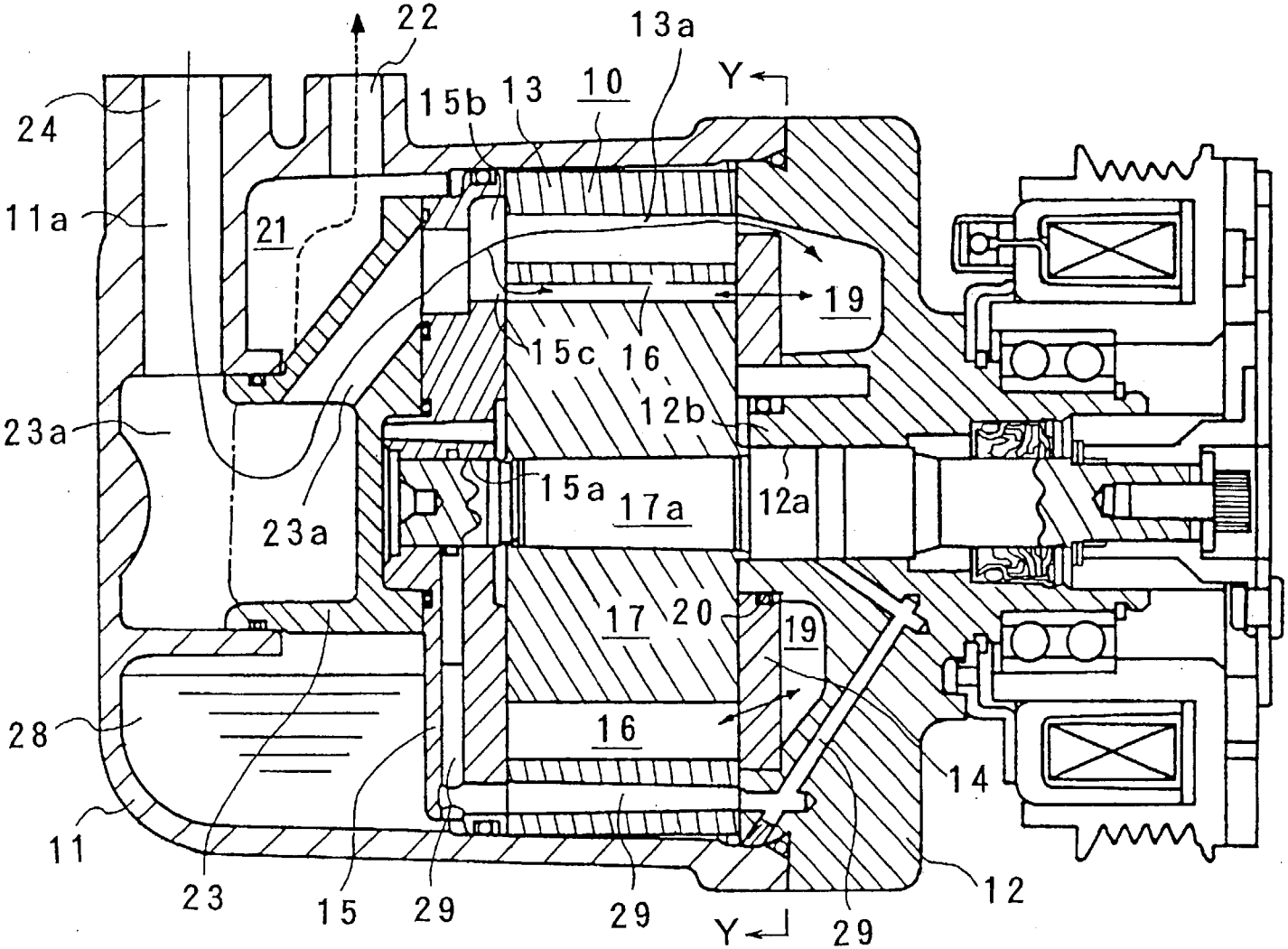
FIG. 4 is a cross-sectional view of another gas compressor according to the invention, taken on line B—B of FIG. 5.
Figure 5:
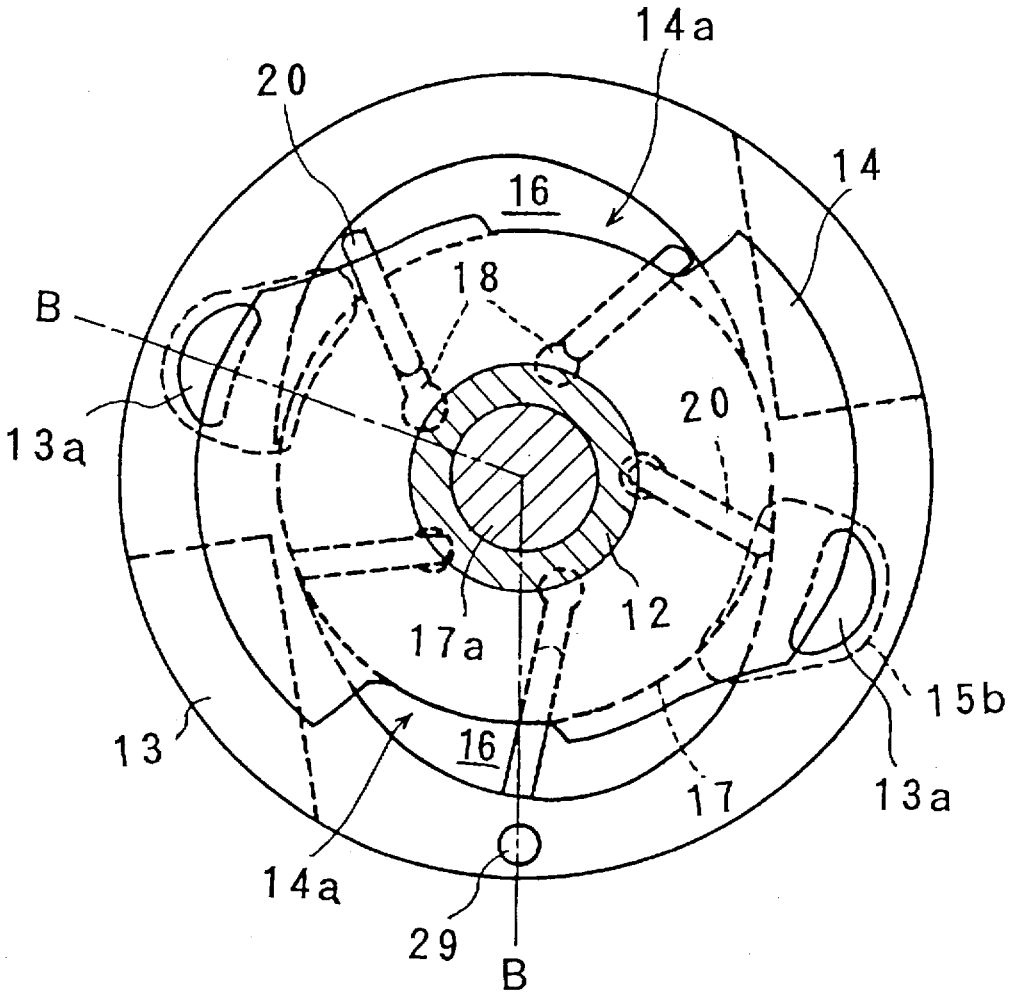
FIG. 5 is a partially cutaway cross section taken on line Y—Y of FIG. 4, and in which the compression volume takes its minimum value.
Figure 6:
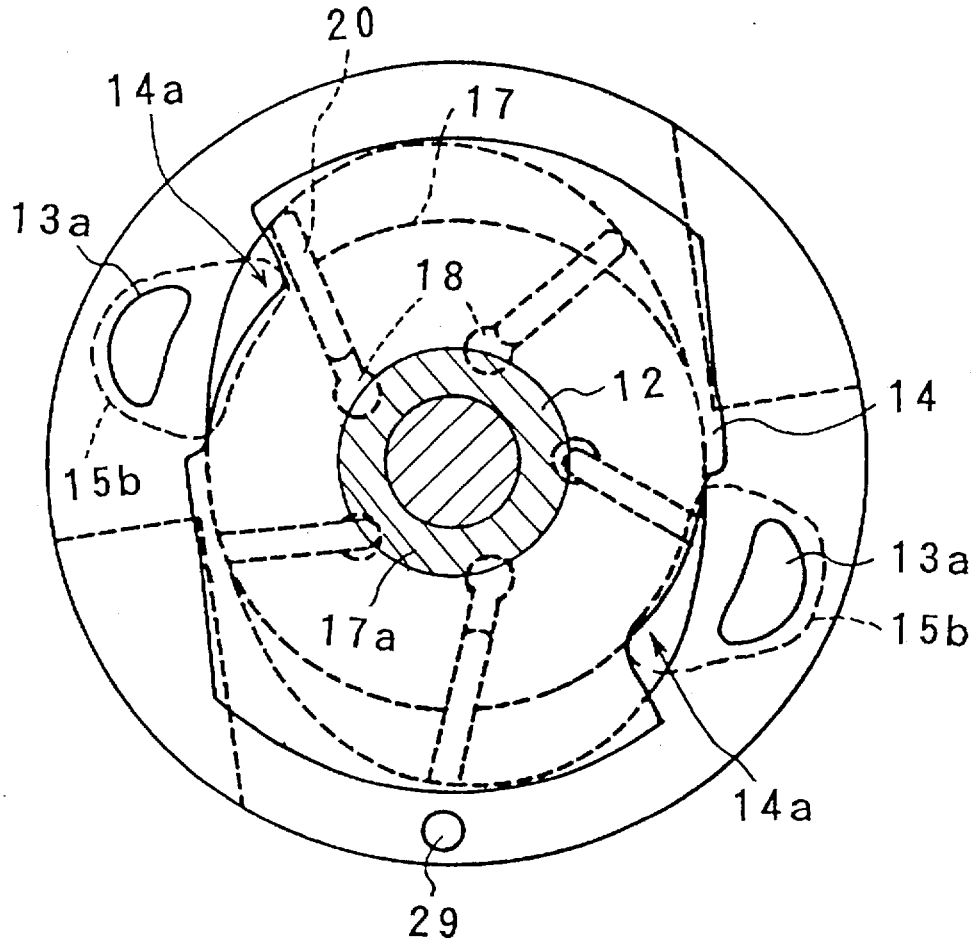
FIG. 6 is a partially cutaway cross section taken on line Y—Y of FIG. 4, and in which the compression volume takes its maximum value.

Another gas compressor according to the present invention is next described. FIG. 4 is a cross section of this gas compressor. FIG. 5 is a partially cutaway cross section taken on line Y—Y of FIG. 4, and shows the state in which the compression volume assumes its minimum value. FIG. 6 is a partially cutaway cross-sectional view taken on line Y—Y of FIG. 4, and shows the state in which the compression volume assumes its maximum value.

This gas compressor shown in FIGS. 4–6 is similar to the gas compressor already described in connection with FIGS. 1–3 except that the gas supply passage 15*b* extending in the direction of thickness of the rear-side block 15 is enlarged on the side of the cylinder chamber 16 to thereby form an inlet hole 15*c*, and that this inlet hole 15*c* places the gas supply passage 15*b* and the cylinder chamber 16 in communication with each other.

This gas compressor operates in the manner as described now. When the amount of compression of gas in the cylinder chamber 16 takes its maximum value, the control plate 14 is in the position shown in FIG. 6. Under this condition, movement of the vanes 20 draws external refrigerant gas into the cylinder chamber 16 via the intake port 24, the gas supply passages 11*a*, 23*a*, 15*b*, and the inlet hole 15*c*, as indicated by the solid line in FIG. 4. Also, the gas flows into the cylinder chamber 16 through the gas supply passage 13*a*, the gas exchange chamber 19, and the inlet hole 14*a* in the control plate 14. This drawn gas is compressed by the movement of the vanes 20 without being bypassed to the gas exchange chamber 19 from the inlet hole 14*a*.

If the control plate 14 is rotated in a clockwise direction from the position shown in FIG. 6, the amount of compression of the refrigerant gas in the cylinder chamber 16 decreases gradually. When the control plate 14 arrives at the position shown in FIG. 5, the compression volume assumes its minimum value. At this time, the area of the inlet opening in the cylinder chamber 16 takes its maximum value, as shown in FIG. 5. Therefore, the refrigerant gas drawn into the cylinder chamber 16 by movement of the vanes 20 is bypassed in quantity to the gas exchange chamber 19 via the inlet hole 14*a* until compression by the vanes 20 is started.

Therefore, pressure variations in the gas exchange chamber 19 are increased. Normally, the increased pressure variations would be transmitted to the external piping and evaporator. However, the gas exchange chamber 19 in which the pressure variations are caused is placed in communication with the outside via the gas supply passages 13*a*, 15*b*, 23*a*, and 11*a*. Furthermore, the distance to the outside is considerably large. Accordingly, these gas supply passages 13*a*, 15*b*, 23*a*, and 11*a* mitigate the pressure variations transmitted to the outside, the variations being created inside the gas exchange chamber 19. Consequently, the pressure variations are less transmitted to the outside. Moreover, the gas supply passages 13*a*, 15*b*, 23*a*, and 11*a* act as a muffler. Hence, it is unlikely that the pressure variations produced inside the gas exchange chamber 19 are transmitted to the external piping, evaporator, and so on to thereby produce noise.

As described above, in the present embodiment, pressure variations created inside the gas exchange chamber 19 can be prevented from being transmitted to the outside in the same way as in the embodiment described previously in conjunction with FIGS. 1–3. Hence, this embodiment yields the same advantages as the first-described embodiment.

Figure 7:
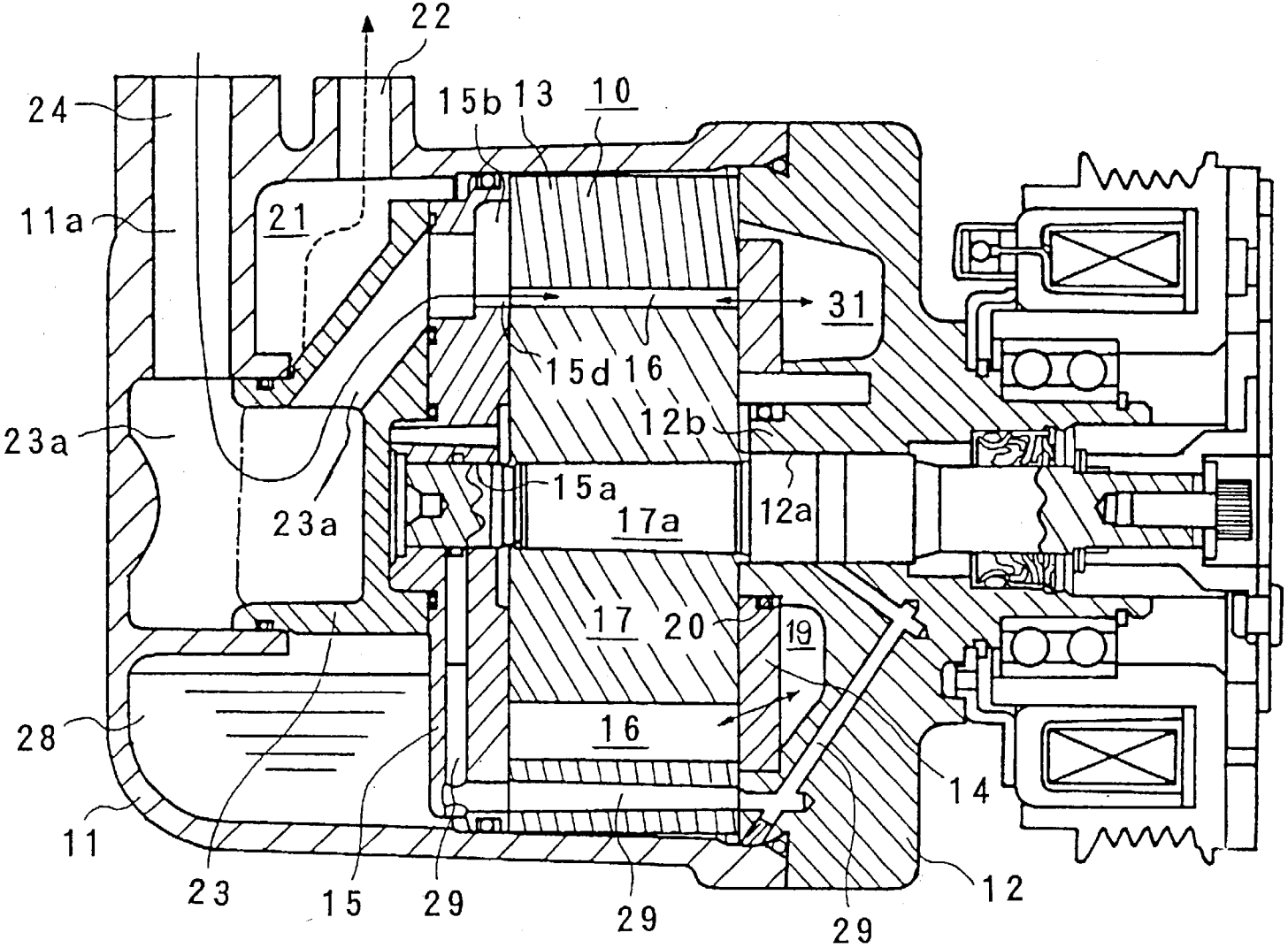
FIG. 7 is a cross-sectional view similar to FIG. 1, but showing a further gas compressor according to the invention.
Figure 8:
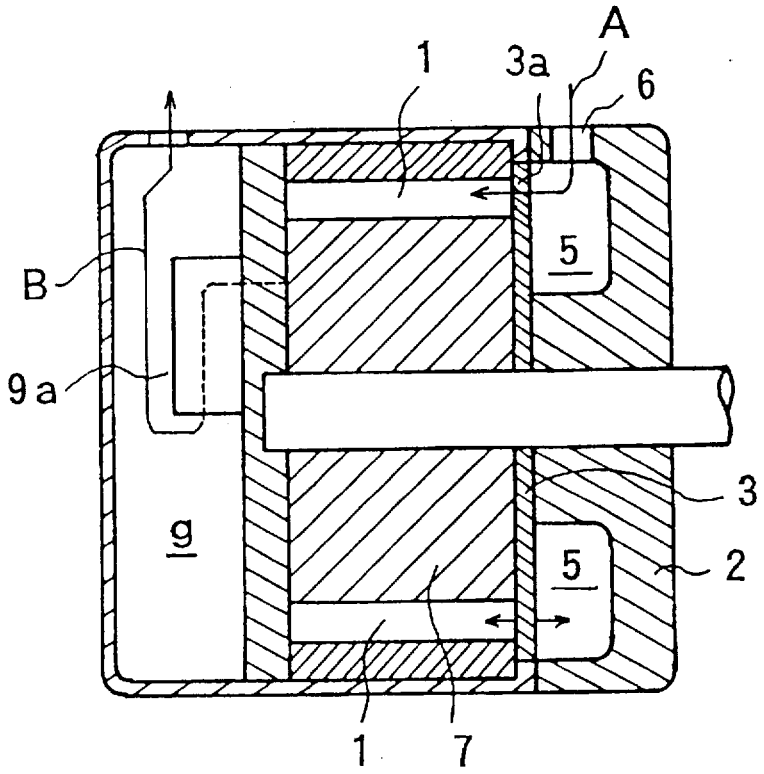
FIG. 8 PRIOR ART
FIG. 8 is a schematic cross section of the prior art gas compressor.

A further gas compressor according to the invention is next described by referring to FIG. 7, which is a cross-sectional view of this gas compressor. This gas compressor is similar to the embodiment described already in connection with FIGS. 1–3 except for the following points. The gas exchange chamber 19 forms a gas refuge chamber 31 used only to save refrigerant gas bypassed from the cylinder chamber 16. The gas supply passage 13*a* formed in the cylindrical block 13 is omitted to break direct communication of the gas refuge chamber 31 with the outside. The part of the gas supply passage 15*b* which is formed in the rear-side block 15 and located on the side of the cylinder chamber 16 is enlarged so that this part acts as an inlet hole 15*d*. This inlet hole 15*d* places the gas supply passage 15*b* in communication with the cylinder chamber 16.

The operation of this gas compressor constructed in this way is next described. When the compression volume of the refrigerant gas inside the cylinder chamber 16 is greatest, the control plate 14 is in the same position as in the first-mentioned embodiment (see FIG. 3). Under this condition, external refrigerant gas is drawn into the cylinder chamber 16 via the intake port 24, the gas supply passages 11*a*, 23*a*, 15*b*, and the inlet port 15*d* by movement of the vanes 20, as indicated by the solid line in FIG. 7. The drawn refrigerant gas is compressed by the movement of the vanes 20 without being bypassed from the inlet hole 14*a* in the control plate 14 to the gas refuge chamber 31.

If the control plate 14 is rotated in a clockwise direction from the position shown in FIG. 3 in the same way as the first-mentioned embodiment, the amount of compression of the refrigerant gas in the cylinder chamber 16 decreases gradually. When the control plate 14 arrives at the position shown in FIG. 2, the compression volume assumes its minimum value. At this time, the area of the inlet opening in the cylinder chamber 16 takes its maximum value. Therefore, the refrigerant gas drawn into the cylinder chamber 16 by movement of the vanes 20 is bypassed to the gas refuge chamber 31 in quantity via the inlet hole 14*a* until compression by the vanes 20 is started.

Therefore, greater pressure variations are induced inside the gas refuge chamber 31 and would normally be transmitted to the external piping and evaporator. However, this gas refuge chamber 31 is in communication with the outside via the cylinder chamber 16, the inlet hole 15*d*, and the gas supply passages 15*b*, 23*a*, and 11*a*. Furthermore, the distance from the gas refuge chamber 31 to the outside is considerably large. These gas supply passages 15*b*, 23*a*, 11*a*, and so on mitigate the pressure variations transmitted to the outside from inside the gas refuge chamber 31. As a consequence, the pressure variations are less transmitted to the outside. Furthermore, the gas supply passages 15*b*, 23*a*, and 11*a* act as a muffler. Normally, pressure variations produced inside the gas refuge chamber 31 would be transmitted to the external piping and evaporator, thus generating noise.

As described thus far, in the embodiment described in conjunction with FIG. 7, the gas refuge chamber 31 is formed only to bypass the refrigerant gas drawn into the cylinder chamber 16. This gas refuge chamber 31 is placed in communication with the outside via the gas supply passages 15*b*, 23*a*, and 11*a* extending into the cylinder chamber 16 and into the discharge chamber 21. These gas supply passages 15*b*, 23*a*, and 11*a* prevent pressure variations created inside the gas refuge chamber 31 from being transmitted to the outside. Consequently, in this embodiment, pressure variations produced in the gas refuge chamber 31 are prevented from being transmitted to external piping and evaporator without increasing the size of the whole machine and without incurring a great increase in the cost of fabricating the machine; otherwise noise would be created.

In the novel gas compressor, a gas exchange chamber for exchanging gas with a gas compression portion is formed. This gas exchange chamber is placed in communication with the outside via long gas supply passages. These gas supply passages prevent pressure variations produced inside a gas refuge chamber from being transmitted to the outside. Therefore, in the present invention, noise created by transmission of pressure variations to external piping, evaporator, or the like can be reduced without increasing the size of the whole machine and without incurring a great increase in the fabrication cost, the pressure variations being generated inside gas intake portions.

What is claimed is:

1. A gas compressor comprising:

a gas compression portion for compressing gas by a volume change caused by rotary motion of a rotating body;

a gas exchange chamber placed at a first side of said gas compression portion and acting to exchange the gas with said gas compression portion;

a control means disposed between said gas exchange chamber and said gas compression portion and having an opening for placing said gas compression portion and said gas exchange chamber in communication with each other, said opening having an effective area, said control means being designed to control compression volume of said gas compression portion by adjusting the effective area of said opening;

a gas discharge portion disposed at a second side of said gas compression portion and having a discharge opening from which the gas compressed in said gas compression portion is discharged; and gas supply passages having a gas inlet port for drawing in the gas, said gas inlet port being located at said second side of said gas compression portion, said gas supply passages permitting supply of the gas to said gas compression portion.

2. The gas compressor according to claim 1, wherein said gas supply passages are connected with said gas exchange chamber via said gas discharge portion and via said gas compression portion.

3. The gas compressor according to claim 2, wherein said gas supply passages are connected with said gas discharge portion which is, in turn, connected with said gas compression portion.

* * * * *